US006250128B1

(12) United States Patent
Ando et al.

(10) Patent No.: US 6,250,128 B1
(45) Date of Patent: Jun. 26, 2001

(54) FORGING DIE AND UPSET FORGING METHOD

(75) Inventors: Hiroyuki Ando; Isamu Matsumoto, both of Ishikawa; Akira Yamamoto; Yoshihiro Ishihara, both of Kyoto, all of (JP)

(73) Assignees: Komatsu Industries Corporation, Tokyo; Nichidai Corporation, Kyoto, both of (JP)

( * ) Notice: Subject to any disclaimer, the term of this patent is extended or adjusted under 35 U.S.C. 154(b) by 0 days.

(21) Appl. No.: 09/402,913

(22) PCT Filed: Apr. 22, 1998

(86) PCT No.: PCT/JP98/01858

§ 371 Date: Oct. 13, 1999

§ 102(e) Date: Oct. 13, 1999

(87) PCT Pub. No.: WO98/47646

PCT Pub. Date: Oct. 29, 1998

(30) Foreign Application Priority Data

Apr. 22, 1997 (JP) ..... 9-104154
Apr. 22, 1997 (JP) ..... 9-104173

(51) Int. Cl.[7] ..... B21J 13/00

(52) U.S. Cl. ..... 72/355.6; 72/20.2; 72/344; 72/355.2; 72/376; 72/453.01

(58) Field of Search ..... 72/344, 353.2, 72/354.6, 355.2, 355.6, 376, 20.1, 20.2, 453.01

(56) References Cited

U.S. PATENT DOCUMENTS 4,831,861 * 5/1989 Hofmann et al. ..... 72/355.6
5,218,853 * 6/1993 Mueller et al. ..... 72/355.6
5,746,085 * 5/1998 Harada et al. ..... 72/355.6

FOREIGN PATENT DOCUMENTS 60-30545 * 2/1985 (JP) ..... 72/355.6
2-179337 * 7/1990 (JP) ..... 72/355.6
4-294838 10/1992 (JP) .
5-154598 6/1993 (JP) .
9-99337 4/1997 (JP) .

* cited by examiner

*Primary Examiner*—Ed Tolan
(74) *Attorney, Agent, or Firm*—Frishauf, Holtz, Goodman, Langer & Chick, P.C.

(57) ABSTRACT

An upset forging die device and method are provided for upset-forging a raw material that is being filled in a cavity of a lower molding die at a portion between an upper punch of an upper molding die provided on a slide and a lower punch of the lower molding die provided on a bolster. The upper and lower punches are provided with an upper pin and a lower pin respectively so that a first end of each pin is protruded and withdrawn from each of end surfaces of the upper and lower punches and the pins are vertically movable in the upper and lower punches respectively, while a second end of the upper and lower pins is applied with a back-pressure. The back-pressure is applied to each of the upper and lower pins by causing a hydraulic oil supply to supply hydraulic oil to hydraulic cylinders at a time of a molding operation, and the respective back-pressures are removed by switching a solenoid valve to take a communicating position to discharge the hydraulic oil to an oil tank just before the cavity is completely filled up with the raw material.

7 Claims, 9 Drawing Sheets

FORGING DIE AND UPSET FORGING METHOD

TECHNICAL FIELD

The present invention relates to a forging die device used in cold and hot forging operations and to an upset forging method using the forging die device for forging parts such as a gear or the like.

BACKGROUND ART

Conventionally, machinery parts such as a gear or the like are worked by utilizing metal cutting machines such as gear cutting machine or the like because it is required for the parts to have a high accuracy. However, according to this method, much time is required to work the parts, so that productivity is disadvantageously lowered.

To improve such disadvantages, there has been proposed and actually used a method of manufacturing a small-sized gear by utilizing a forging method. However, in a case where the gear is manufactured by the forging method, many processes such as extruding, upsetting of raw material, ironing of a tooth surface of the gear, or the like are required, so that a surface pressure to be applied to the tooth surface is increased thereby to cause burning or the like. As a result, there is inevitably posed the disadvantage that molding with high accuracy cannot be performed.

In order to improve such disadvantages, for example, an official gazette of Japanese Patent Laid-open Publication No. HEI 5-154598 has proposed a forging method in which a raw material is forged to form a spur gear without increasing the surface pressure of the tooth portion of the gear.

The method of forging the spur gear disclosed in the official gazette is characterized by comprising: a first working process in which a raw material is upset-molded into a primary worked gear having a gear-shape whose tooth profile is set to be smaller than that of a spur gear to be obtained; a second working process in which the material is freely flowed at portions other than tooth portion of the primary worked gear while the gear is compressively molded into a secondary worked gear; and a third working process in which the secondary worked gear is ironically molded into a final product, and wherein the respective processes are performed in accordance with a cold forging working method.

According to the above method, an ironing allowance for the ironical-molding operation is stably formed, so that there can be provided an effect of obtaining a product having a high accuracy by a low molding load.

Further, as a conventional extrusion working method, there is a method in which the material is extrusion-molded using a punch having a hole portion thereby to form a convex portion from the hole portion of the punch, a free end portion of the convex portion is extrusion-worked under a state of being pressed with a predetermined pressure, and the pressure is reduced or removed before the extrusion-work is completed. This method provides an effect of greatly reducing a maximum load to be applied to the molding die in the vicinity of a bottom dead point of the molding die.

However, in the forging method described in the above mentioned official gazette, since the raw material is molded in advance so as to have a gear-shape whose tooth profile is set to be smaller than that of a spur gear to be obtained, one or two processes are required for molding the raw material to form a gear-shape. In addition, three processes are required for forging the raw material, and the number of processes is increased, so that the forging operation requires much time, providing a disadvantage of lowering the productivity.

In addition, changing the punch for every process, the forging operation is performed, the changing work of the punch becomes to be complicated, and a plurality of punches and mandrels are required to be prepared in advance, so that there is posed a disadvantage of increasing the cost of the molding dies.

On the other hand, in the conventional extrusion working method, the material is subjected to a back-extrusion while a flow of the material is partially suppressed by a pressing member provided to an upper punch, and the pressing force of the pressing member is reduced or removed before the extrusion-work is completed, so that a high surface pressure is applied to the molding die from a time when the molding operation is started. As a result, there may be caused various disadvantages such that the molding die causes burning and a life of the molding die decreases in a short period of time.

In addition, in the conventional extrusion working method described above, since the device for effecting the method has a structure in which the pressing member is provided only to the upper punch side, the pressing forces of the upper and lower punches are not uniform with each other and the material flows in only one direction, so that there may also be posed disadvantages such that a strength of the product is lowered, and defects such as cracks and shrinkage cavity are liable to be caused in the product.

Therefore, the present invention has been achieved for improving such disadvantages, and an object of the present invention is to provide a forging die device and upset-forging method capable of forging parts such as a gear having a high accuracy without requiring the pre-working of the raw material and the change of dies during the forging, thereby to improve the productivity and to decrease the cost of the molding dies.

DISCLOSURE OF THE INVENTION

In order to achieve the aforementioned object, in a first aspect of this invention, there is provided a forging die device for upset-forging a raw material filling in a cavity of a lower molding die at a portion between an upper punch of an upper molding die provided to a slide and an lower punch of the lower molding die provided onto a bolster, wherein the upper and lower punches are provided with an upper pin and a lower pin respectively so that one end of each pin is protruded and withdrawn from each of end surfaces of the upper and lower punches and the pins are vertically movable in the upper and lower punches respectively, while the other end sides of the upper and lower pins are provided with back-pressure imparting means for imparting a back-pressure to each of the upper and lower pins at a time of molding operation and for removing the respective back-pressures immediately before the cavity has been completely filled up with the raw material.

According to this structure, at an initial stage of the molding, the raw material can be flowed to the tooth molding portions with a high pressing force, so that there can be obtained a gear having no lacking portion in tooth portion and having a good quality. At the same time, before the molding load is rapidly increased because the cavity is filled up with the raw material to be completely closed, the back-pressures of the upper and lower pins are removed immediately to allow the upper and lower pins to move in a direction reverse to the pressing direction of the upper and lower punches, so that the raw material can flow into the concave waste hole portion formed by the initial back-pressure and flow into an unfilled portion (a portion which has not been injected) at the outer peripheral portion, and the raw material can be injected so as to have a thickness of the final shape of the product, so that it becomes possible to mold a gear without requiring a large molding load.

Due to this operation, the surface pressure to be applied to the molding die becomes small, the life of the molding die is improved. In addition to this, a pressing capacity can be reduced, so that it becomes possible to upset-forge a gear by using a small-sized pressing machine.

In addition, each of the upper and lower punches is provided with the upper and lower pins respectively and the raw material is pressed by the upper and lower pins in the vertical direction, so that the raw material is uniformly pressured in a vertical direction. Due to this operation, the flow of the raw material becomes to be uniform, so that there can be provided a product in which the fiber flow is uniformly arranged and a product having a high strength and accuracy. Further, since defectives such as crack or shrinkage cavity do not occur, a rate of occurrence of the defectives can be greatly reduced.

Furthermore, if the raw material is subjected to a surface lubricating treatment (bonderizing treatment) in advance, an oil-shortage accident would not occur on the surface of the raw material during the molding operation, so that the occurrence of burning can be prevented and it becomes possible to improve the life of the molding die.

In the first aspect of the present invention described above, it is preferred to constitute the back-pressure imparting means by:

hydraulic cylinders for applying a back-pressure to the upper and lower pins respectively by a hydraulic oil;

a hydraulic oil supplying means for supplying the hydraulic oil to the hydraulic cylinders; and a solenoid valve for shutting-off and communicating a circuit between the hydraulic cylinders and the hydraulic oil supplying means.

According to the structure described above, immediately before the time when the cavity is filled up with the raw material and the molding load is rapidly increased, the solenoid valve is opened so as to discharge the hydraulic oil in the hydraulic cylinder, so that the removal of the back-pressures of the upper and lower pins can be performed automatically.

In addition to the structure described above, it is preferred that the lower molding die is provided with a knockout pin for knocking-out the raw material in the cavity by pushing up the lower pin after the molding operation.

According to the structure described above, when the knockout pin pushes up the lower pin after the molding operation, it is possible to knockout the raw material in the cavity. At the same time, the raw material is knocked-out by rising up the formed waste hole portion by the lower pin, so that a knockout-mark would not remain on the product thereby to improve quality of the product.

Further, the lower pin serves as well as the knockout pin, there is no need to separately provide the knockout pin, so that the structure of the molding die can be simplified thereby to reduce the cost of the molding dies.

In the structure described above, a knocking-out speed of the knockout pin is preferably set to 20 mm/sec or less.

According to the structure described above, it becomes possible to knockout the raw material without causing burning on a surface of the material and to mold helical gear, bevel gear or the like with high accuracy.

In a second aspect of the present invention, there is provided an upset-forging method comprising the steps of:

imparting a back-pressure to an upper pin provided to an upper punch and to a lower pin provided to a lower punch;

contacting under pressure a lower surface of the upper punch to an upper surface of a molding die under a state where a tip portion of the upper pin is protruded from the lower surface of the upper punch and a tip portion of the lower pin is protruded from the upper surface of the lower punch thereby to close a cavity;

subsequently pressing a raw material in the cavity by means of the upper and lower pins so that the raw material flows into the cavity, simultaneously pressing the raw material at a portion between the upper punch and the lower punch, so that the cavity is filled up with the raw material until a time just before the raw material has completely filled; and thereafter, further pressing the raw material by means of the upper and lower punches under a state that the back-pressures of the upper and lower pins are removed thereby to mold the raw material in a final shape.

According to the method described above, since it becomes possible to mold a part in one process, the productivity can be greatly improved. In addition, the raw material is simultaneously pressed in a vertical direction by the upper and lower pins provided in the upper punch and the lower punch respectively, so that the raw material is uniformly pressured in a vertical direction. Due to this operation, the flow of the raw material becomes to be uniform, so that there can be provided a product in which the fiber flow is uniformly arranged and the product having a high strength and accuracy. Further, since the defectives such as crack or shrinkage cavity do not occur, a rate of occurrence of the defectives can be greatly reduced.

In addition, the back-pressures of the upper and lower pins are removed at a time just before the cavity has been completely closed by the raw material and the molding load is rapidly increased, so that the molding load can be greatly reduced, so that a surface pressure to be applied to the molding die can be reduced. Therefore, wearing of the molding die is reduced, thus resulting in increase of the usable life of the molding die. Further, it becomes possible to mold a part using a small-size forging press machine, thus being economical indeed.

In addition, when the raw material is subjected to a surface lubricating treatment (bonderizing treatment) in advance, an oil-shortage accident would not occur on the surface of the raw material during the molding operation, so that the occurrence of burning can be prevented and it becomes possible to improve the life of the molding die.

In a third aspect of the present invention, there is provided an upset-forging method comprising the steps of:

tightly closing a cavity by contacting, under pressure, a lower surface of the upper punch to an upper surface of a molding die;

imparting a back-pressure to an upper pin provided to an upper punch and to a lower pin provided to a lower punch, so that a tip portion of the upper pin is protruded from the lower surface of the upper punch and a tip portion of the lower pin is protruded from the upper surface of the lower punch and a raw material in the cavity is then pressed by means of the tip portions so that the raw material flows into the cavity, simultaneously pressing the raw material at a portion between the upper punch and the lower punch, so that the cavity is filled up with the raw material until a time just before the raw material has completely filled; and thereafter, further pressing the raw material by means of the upper and lower punches under a state that the back-pressure of the upper and lower pins are removed thereby to mold the raw material in a final shape.

According to the method described above, the same effects as those in the second aspect of this invention can be obtained.

In the second and third aspects of the present invention, it is preferred to press the raw material by using the upper and lower pins each provided with a tapered-portion at the tip portions of the upper and lower pins.

According to the method described above, when the raw material is knocked-out, the upper and lower pins are easily drawn out from the raw material, so that it becomes possible to reduce the knockout force.

BRIEF DESCRIPTION OF THE DRAWINGS

The present invention will become more apparent upon a consideration of the following detailed description of the preferred embodiments of the present invention taken in conjunction with the accompanying drawings. It is to be understood that the embodiments in the drawings are not for specifying the present invention but for merely making the explanations and understanding of the present invention more easily.

In the accompanying drawings.

BEST MODE FOR EMBODYING THE INVENTION

Hereunder, preferred embodiments of the forging die device and the swage forging method according to the present invention will be explained with reference to the accompanying drawings.

At first, a first embodiment of the forging die device according to the present invention will be described in detail with reference to the accompanying drawings.

Figure 1:
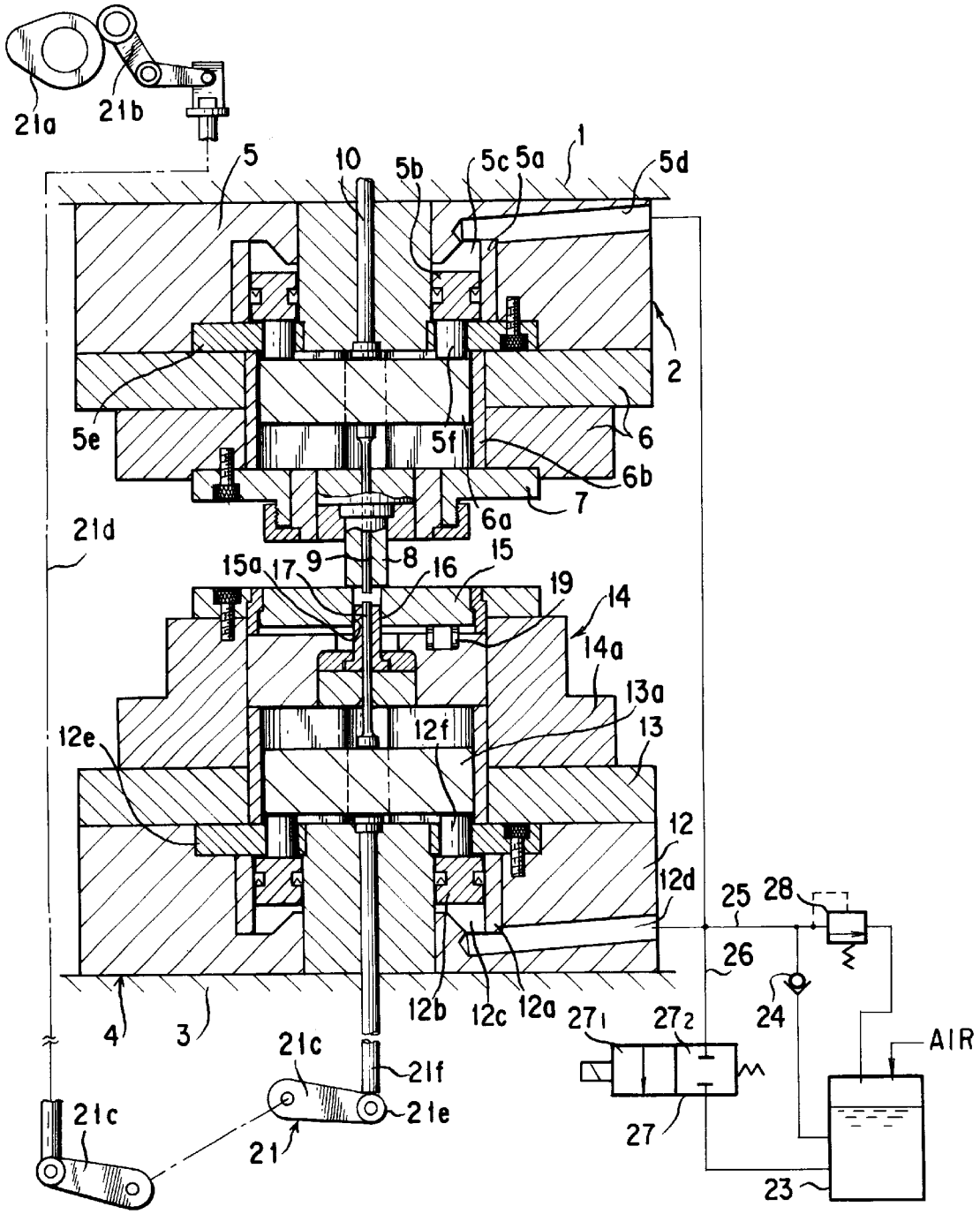
FIG. 1 is a view showing an overall structure of a forging die device of a first embodiment of the present invention.
Figure 2:
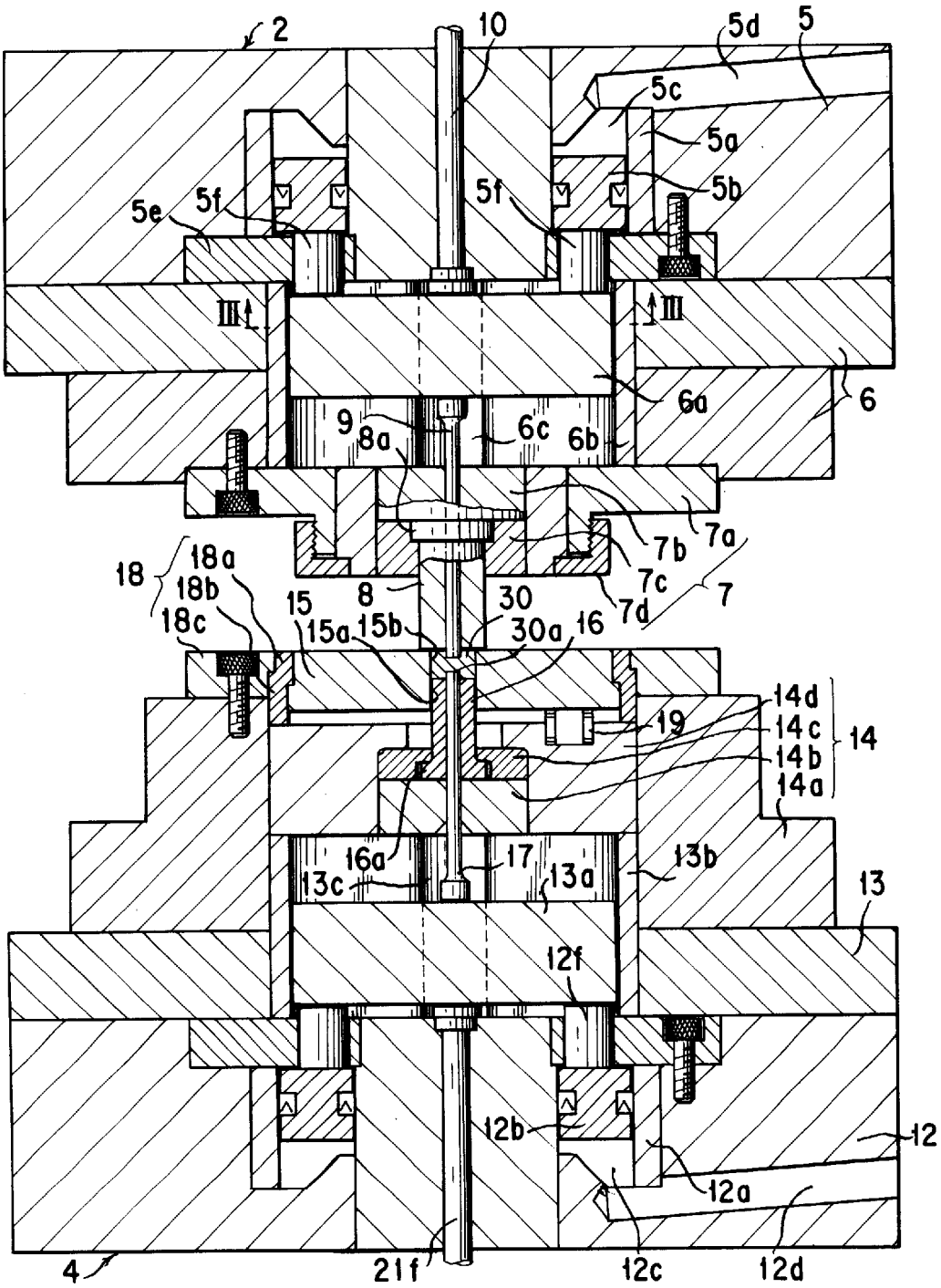
FIG. 2 is a cross sectional view of the above first embodiment.
Figure 3:
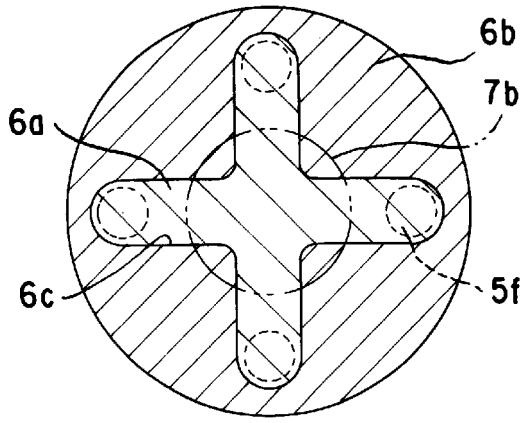
FIG. 3 is a cross sectional view taken along the line III—III of FIG. 2.
Figure 4:
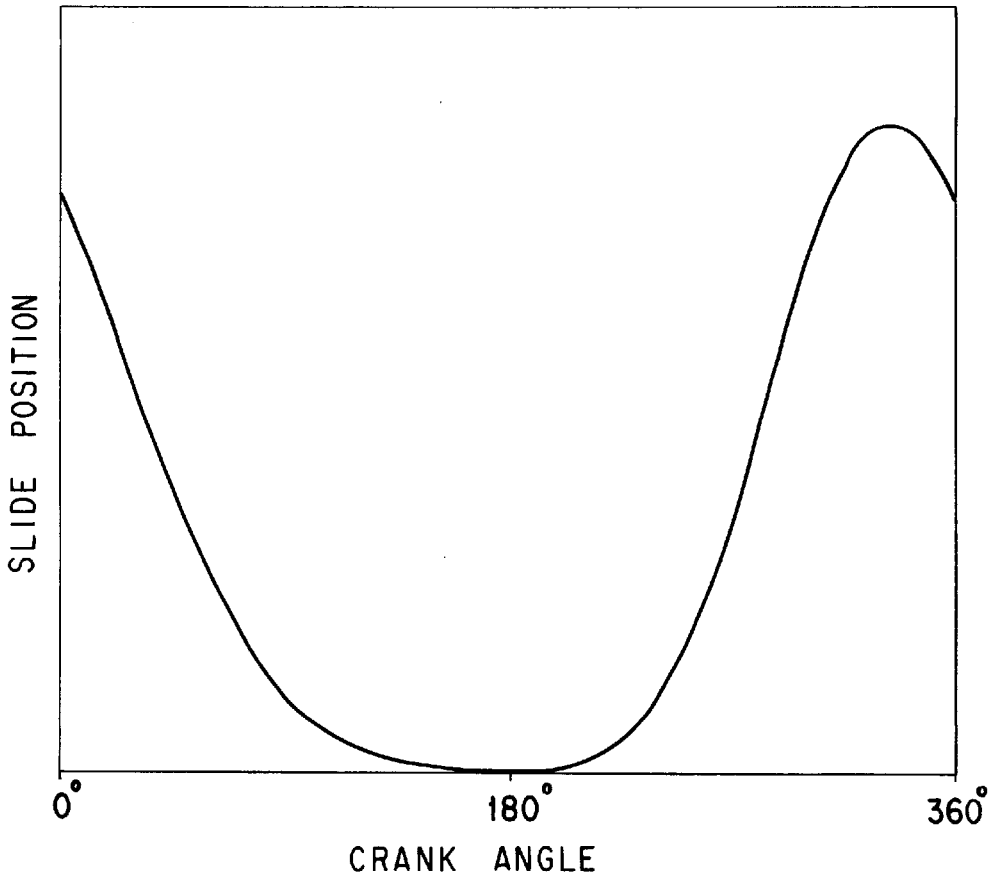
FIG. 4 is a slide-stroke curve showing an operation of the above first embodiment of the present invention.

FIG. 1 is a view showing an overall structure of a forging die device, FIG. 2 is a cross sectional view of the die device, FIG. 3 is a cross sectional view taken along the line III—III of FIG. 2 and FIG. 4 is a slide-stroke curve.

This die device comprises an upper molding die 2 provided on a lower surface of a slide 1 which is vertically moved by a slide driving means (not shown) and a lower molding die 4 fixed to an upper surface of a bolster 3 provided below the slide 1.

As shown in FIG. 2, the upper molding die 2 comprises an upper cylinder block 5 attached to a lower surface of the slide 1, an upper support member 6 fixed to a lower surface of the upper cylinder block 5 and an upper punch 8 attached to a lower surface of the upper support member 6, wherein an upper pin 9 is provided so as to penetrate in a vertical direction through a center portion of the upper punch 8.

A cylinder ring 5*a* is provided in the upper cylinder block 5 and a piston 5*b* is accommodated in the cylinder ring 5*a* so as to be slidable in a vertical direction. An upper side of the piston 5*b* constitutes a hydraulic chamber 5*c* to which the hydraulic oil is supplied through a path 5*d* from a hydraulic oil supplying means as described later on.

Each of upper end portions of a plurality of operation pins 5*f* penetrating an end plate 5*e* in a vertical direction abuts against a lower surface of the piston 5*b*, while each of lower end portions of the operation pins 5*f* abuts against an upper surface of a pressing plate 6*a* provided in the upper support member 6.

As shown in FIG. 3, the pressing plate 6*a* described above is formed to have a cross-shape in section and is inserted into a guide groove 6*c* having a cross-shaped section of the guide member 6*b* provided in the upper support member 6 so that the pressing plate 6*a* is slidably moved in a vertical direction. A lower end portion of a slide knockout pin 10, which is vertically movable by a slide knockout (not shown), abuts against a center of an upper surface of the pressing plate 6*a* from an upper side.

Furthermore, an upper end portion of the upper pin 9 abuts against a center of a lower surface of the pressing plate 6*a*, while a lower end side of the upper pin 9 penetrates a center portion of the upper punch 8 provided on a lower surface of the upper support member 6 through an upper holder 7, so that the lower end side of the upper pin 9 is protruded from the lower end surface of the upper punch 8 so as to be capable of protruding and withdrawing from the lower surface.

The upper holder 7 described above comprises a hold plate 7*a* fixed to the lower surface of the upper support member 6, a press plate 7*b* accommodated in the hold plate 7*a*, an upper punch attaching plate 7*c* for clamping a head portion 8*a* of the upper punch 8 at a space between the press plate 7*b* and the attaching plate 7*c*, and a nut 7*d* screwed to the hold plate 7*a*, wherein the upper surface of the press plate 7*b* is abutted against the lower surface of the above guide member 6*b*.

Furthermore, the upper end surface of the upper punch 8 abuts against a center of the lower surface of the press plate 7*b*, so that the molding load to be applied to the upper punch 8 at the time of forging operation is received by the guide member 6*b* through the press plate 7*b*.

On the other hand, the lower molding die 4 fixed to a side of the bolster 3 comprises a lower cylinder block 12 fixed to the upper surface of the bolster 3, a lower support member 13 fixed on the lower cylinder block 12 and a molding die 15 attached to the upper surface of the lower support member 13, wherein a lower pin 17 is penetrated to a center portion of the lower punch 16 provided at center of the molding die 15.

A cylinder ring 12*a* is provided in the lower cylinder block 12 and a piston 12*b* is accommodated in the cylinder ring 12*a* so as to be slidably movable in a vertical direction. A lower side of the piston 12*b* constitutes a hydraulic chamber 12*c* to which the hydraulic oil is supplied through a path 12*d* from a hydraulic oil supplying means as described later on.

Each of lower end portions of a plurality of operation pins 12*f* penetrating an end plate 12*e* in a vertical direction abuts against an upper surface of the piston 12*b*, while each of upper end portions of the operation pins 12*f* abuts against a lower surface of a press plate 13*a* provided in the lower support member 13.

As the same as the press plate 6*a* described above, the press plate 13*a* is also formed to have a cross-shape in section and is inserted into a guide groove 13*c* having a cross-shaped section of the guide member 13*b* provided in the upper support member 13. so that the press plate 13*a* is slidably movable in a vertical direction. An upper end portion of a bed knockout pin 21*f*, which is vertically moved by a bed knockout as described later on, abuts against a center of a lower surface of the press plate 13*a* from a lower direction.

Furthermore, a lower end portion of the lower pin 17 abuts against a center of an upper surface of the press plate 13*a*, while an upper end side of the lower pin 17 penetrates a center portion of the lower punch 16 attached to an upper surface of the lower support member 13 through a lower holder 14, so that the upper end side of the lower pin 17 is protruded from the upper end surface of the lower punch 16 so as to be capable of protruding and withdrawing from the upper surface.

The lower holder 14 described above comprises a hold plate 14*a* fixed to the lower support member 13, a spring receiving plate 14*d* accommodated in the hold plate 14*a*, a press plate 14*b* accommodated in the spring receiving plate 14*d*, and an lower punch attaching plate 14*c* for clamping a head portion 16*a* of the lower punch 16 at a space between the press plate 14*b* and the attaching plate 14*c*, wherein the lower surface of the press plate 14*b* and the lower surface of the spring receiving plate 14*d* abut against the upper surface of the above guide member 13*b*.

Furthermore, the lower end surface of the lower punch 16 abuts against a center of the upper surface of the press plate 14*b*, so that the molding load to be applied to the lower punch 16 at the time of forging operation is received by the guide member 13*b* through the press plate 14*b*.

A guide ring 18 formed with a small-diametered portion 18*a* at an upper portion thereof and formed with a large-diametered portion 18*b* at a lower portion thereof is fixed to the hold plate 14*a* of the holder 14 through an attaching plate 18*c*. The die 15 is accommodated into guide ring 18 so as to be movable in a vertical direction.

At a center portion of the die 15, there is formed a molding hole 15*a* having a smaller diameter than that of the upper punch 8 so that the molding hole 15*a* penetrates the die 15 in a vertical direction.

The above molding hole 15*a* is formed to have a tooth-shape of a gear to be molded. An upper end portion of the lower punch 16, having an outer circumference formed with the similar tooth-shape, is inserted into the molding hole 15*a* from a lower direction so that the lower punch 16 is slidably movable in a vertical direction. An upper space from the upper end of the lower punch constitutes a cavity 15*b* for molding the gear. Furthermore, a plurality of compression springs 19 are disposed between the die 15 and the spring receiving plate 14*d*, so that the die 15 is urged in an upper direction by the action of the compression springs 19.

On the other hand, as shown in FIG. 1, the bed knockout 21 comprises a cam 21*a* which is rotated by a driving power outputted from a slide driving mechanism (not shown), so that an upper lever 21*b* is swingably moved by the action of the cam 21*a*.

The upper lever 21*b* is connected to one end side of the an lower lever 21*c* provided to a side of a bed (not shown) through a connecting rod 21*d*, so that the upper lever 21*b* and the lower lever 21*c* are co-operatively swung. Furthermore, at the other end side of the lower lever 21*c*, a cam-follower 21*e* is rotatively supported, and a lower end of a bed knockout pin 21*f* is abutted against an outer periphery of the cam-follower 21*e*.

In addition, as shown in FIG. 1, a hydraulic oil supplying means for supplying the hydraulic oil to the hydraulic chambers 5*c* and 12*c* provided to the upper molding die 2 and the lower molding die 4 comprises an oil tank 23 having a closed-structure having an interior pressurized by air. The hydraulic oil in the oil tank 23 is supplied to the hydraulic chambers 5*c* and 12*c* through a check valve 24 and a passage 25, and a return passage 26, which is arranged in parallel to the check valve 24 and the passage 25, is provided with a solenoid valve 27 having a communicating position $\mathbf{27}_1$ and a shutting-off position $\mathbf{27}_2$.

Further, the reference numeral 28 in FIG. 1 denotes a relief valve for relieving the hydraulic oil, i.e., returning the hydraulic oil to the tank 23 when a pressure in the hydraulic chambers 5*c*, 12*c* become larger than a setting value.

Next, a method for cold-forging or hot-forging the gear by utilizing the die device thus structured will be explained hereunder.

In a state where the slide 1 is stopped at an upper dead point, the piston 5*b* of the upper molding die 2 is lowered while the piston 12*b* of the lower molding die 4 is lifted by the action of the hydraulic oil supplied from the oil tank 23 to the hydraulic chambers 5*c* and 12*c*, so that the the upper pin 9 is held at a lower position while the lower pin 17 is held at a lifting position. At this time, the solenoid valve 27 takes the shutting-off position $\mathbf{27}_2$.

Next, under this condition, a raw material 30 subjected to the surface lubricating treatment (bonderizing treatment) in advance is accommodated into the cavity 15*b* of the die 15 provided to the lower molding die 4. Thereafter, the slide 1 is lowered along the slide-stroke curve shown in FIG. 4, so that the lower surface of the upper punch 8 is contacted to the upper surface of the lower die 15 thereby to close the cavity 15*b* and to upset the raw material 30 into the cavity 15*b*.

Thereafter, when the slide 1 is further lowered, the raw material 30 upset in the cavity 15*b* is pressed in a vertical direction by the upper pin 9 protruded from the lower surface of the upper punch 8 and the lower pin 17 protruded from the upper surface of the lower punch 16, so that a part of the raw material 30 flows into a portion of the cavity 15*b* at which the tooth-shape is formed. As a result, a tooth-shaped portion of the gear is molded. At the same time, a waste hole 30*a* having a concave-shape is molded at both side surfaces of the raw material 30 by the upper and lower pins 9 and 17.

Thereafter, when the slide 1 is further lowered to reach a portion close to the lower dead point, the solenoid valve 27 is switched to take the communicating position $\mathbf{27}_1$ and the hydraulic oil in the hydraulic chambers 5*c* and 12*c* having a high pressure is discharged into the oil tank 23, so that the upper pin 9 and the lower pin 17 protruded from the lower surface of the upper punch 8 and the upper surface of the lower punch 16 due to the initial back pressure up to the present are brought into a state that the upper and lower pins 9 and 17 can be moved in a direction reverse to the pressing direction of the upper punch 8 and the lower punch 16 due to the decreasing of the pressing force of the pistons 5*b* and 12*b*.

Thereafter, the upper punch 8 is further lowered and the raw material 30 is pressed at a portion between the upper punch 8 and the lower punch 16, so that the raw material 30 flows into the waste hole 30*a* while pushing up the upper pin 9 and pushing down the lower pin 17 and then is formed so as to have a thickness of a final shape.

That is, the back-pressures of the upper pin 9 and the lower pin 17 are removed just before the cavity 15*b* is filled up with the raw material 30 to be completely closed, so that excess thickness parts of the raw material 30 can flow into the concave-shaped waste hole 30*a* formed by the upper pin 9 and the lower pin 17 and flow into an unfilled portion (a portion which has not been subjected to injection) at the outer peripheral portion, and the raw material 30 is injected under pressure so as to have a thickness of the final shape of the product. Therefore, a rapid increasing of the molding load due to the completely closed cavity will not occur, and it therefore becomes possible to perform the molding operation with a small molding load.

Furthermore, when the slide 1 once reached to the lower dead point is thereafter started to rise, the lower lever 21*c* of the bed knockout 21 is swung and the cam follower 21*e* pushes up the bed knockout pin 21*f*, so that the lower pin 17 is pushed up through the press plate 13*a*, whereby the raw material 30 having been completely molded is pushed out from the cavity 15*b*.

Further, at this time, the solenoid valve 27 is switched to take the shutting-off position $\mathbf{27}_2$, so that the hydraulic oil in the oil tank 23 pressurized by air flows into the respective hydraulic chambers 5*c* and 12*c* through the check valve 24 and passage 25 so that the upper pin 9 and the lower pin 17 are returned to original positions, respectively.

In this regard, after completion of molding the raw material 30, when the raw material 30 is rapidly knocked-out from the cavity 15*b*, burning or the like will occur on the surface of the product thereby to remarkably lower the quality of the products. Therefore, in the first embodiment, a knocking-out speed is set to 20 mm/sec or less.

Due to this limitation, the knockout of the raw material 30 can be performed without causing the burning on the surface of the raw material 30, so that it becomes possible to obtain a product having a good quality and to mold a helical gear, a bevel gear or the like.

Figure 5:
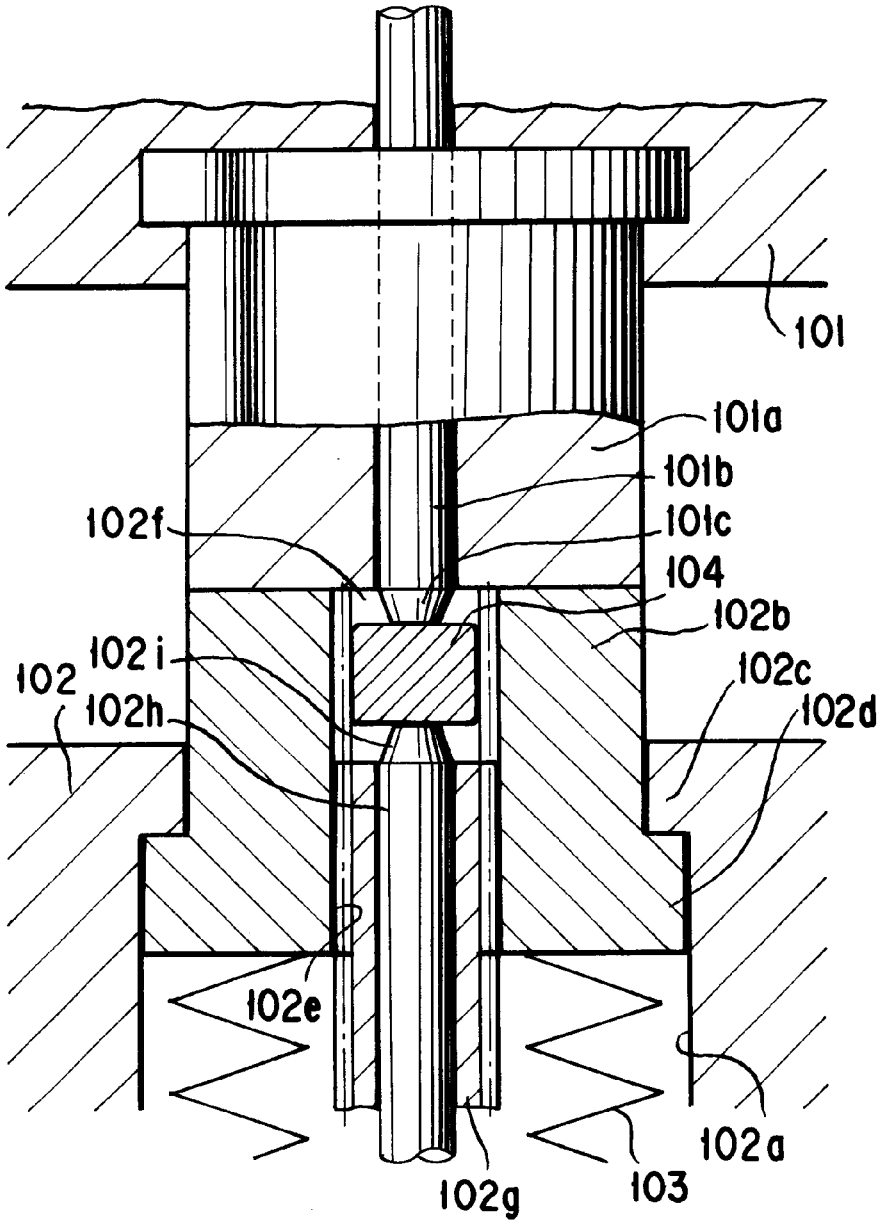
FIG. 5 is a view showing a process of a second embodiment of an upset forging method according to the present invention.
Figure 6:
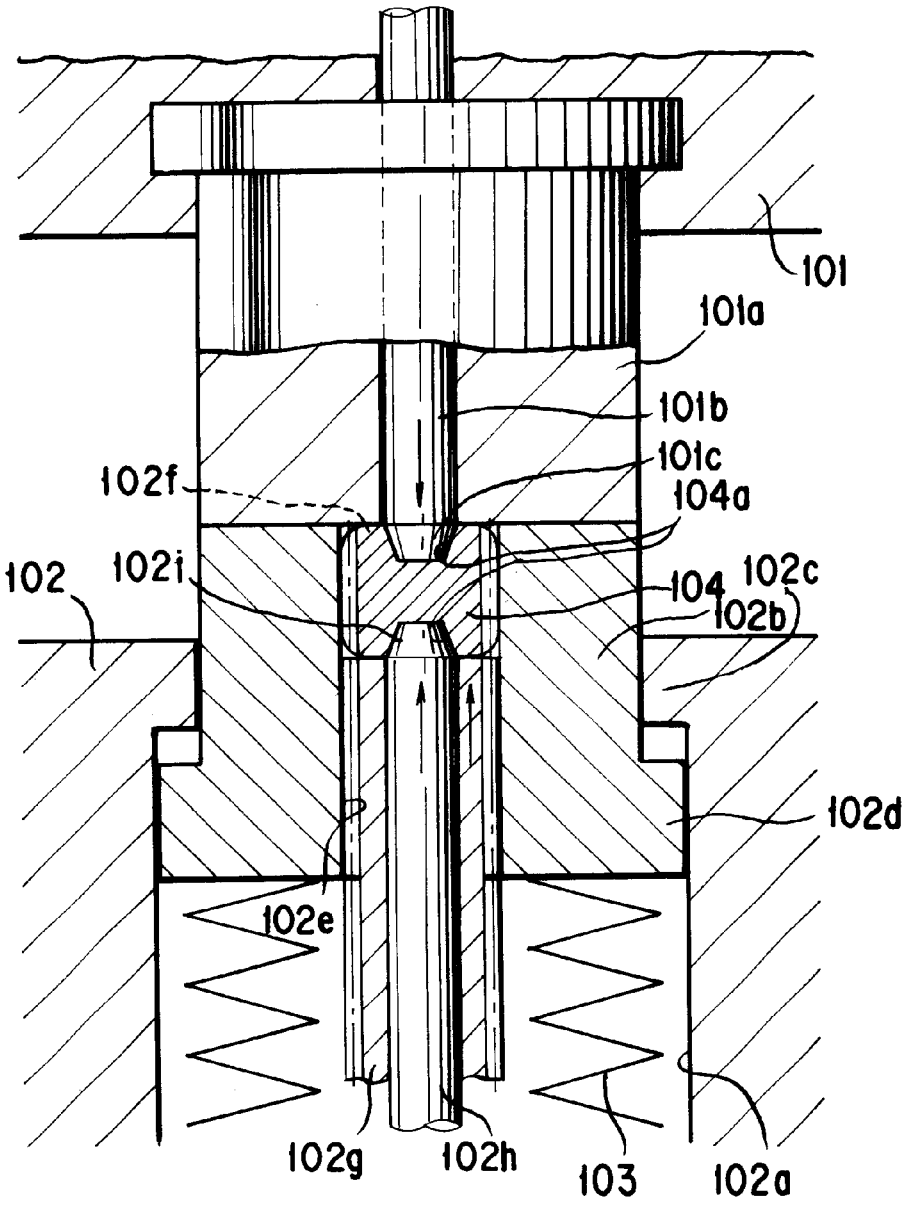
FIG. 6 is a view showing a process of the above second embodiment.
Figure 7:
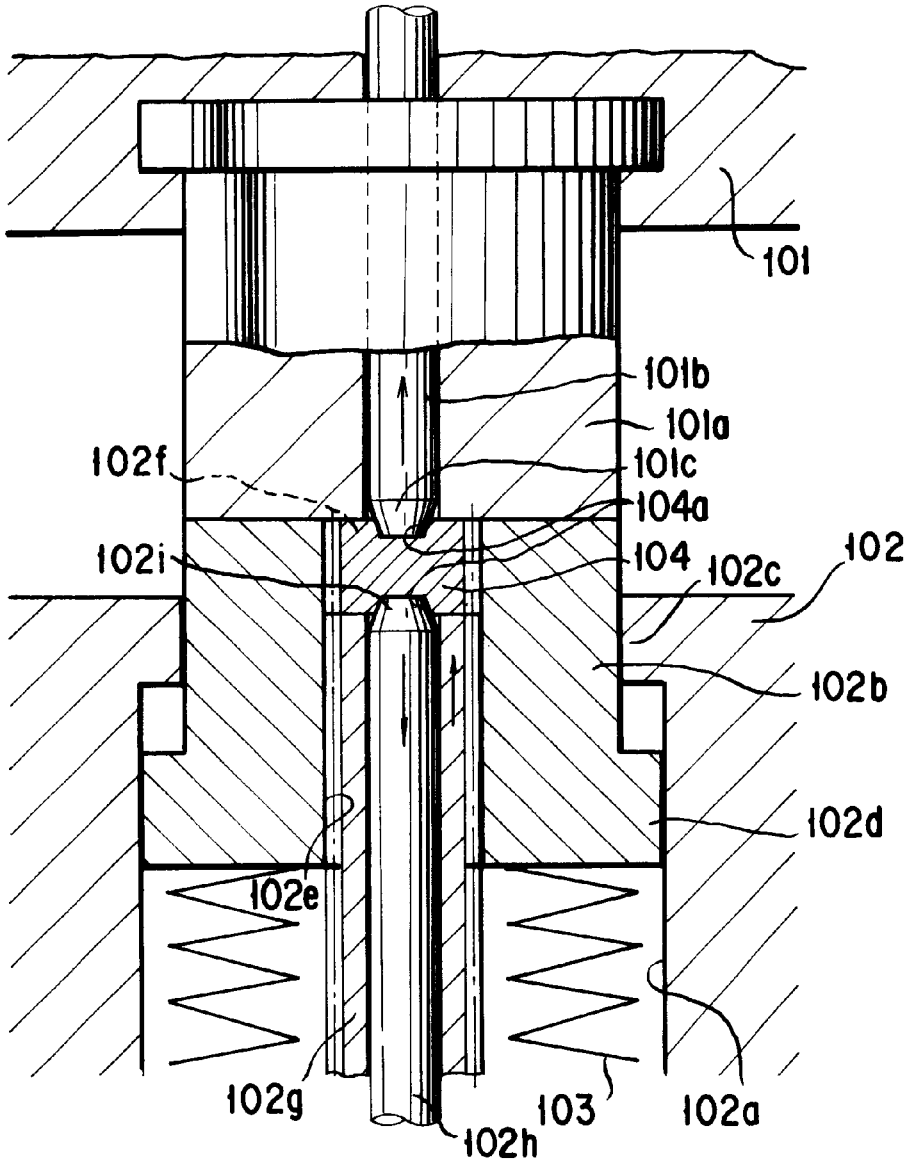
FIG. 7 is a view showing a process of the above second embodiment.

FIGS. 5 to 7 are views respectively representing a second embodiment of the upset forging process according to the present invention in which the reference numeral 101 denotes an upper molding die while the reference numeral 102 denotes a lower molding die.

The aforementioned upper molding die 101 is mounted to a lower surface of the slide of the forging press (see the first embodiment), so that the upper molding die 101 is vertically movable together with the slide and an upper punch 101*a* is fixed to a center portion of the upper molding die 101. Further, an upper pin 101*b* is inserted into a center of the upper punch 101*a* so that the upper pin 101*b* is vertically movable.

An upper end portion of the upper pin 101*b* is connected to a back-pressure imparting means (see the first embodiment) such as a hydraulic cylinder so that a back-pressure can be imparted to the upper pin 101*b* at the time of upset-forging operation. On the other hand, a lower end portion of the upper pin 101*b* is formed with a tapered portion 101*c* of which diameter is gradually reduced towards the tip portion side thereof.

In addition, the lower molding die 102 is fixed on the bolster (see the first embodiment) provided below the slide. The lower molding die 102 comprises a guide bore 102*a* extending in a vertical direction and extending on the same center line as that of the upper punch 101*a*. A die 102*b* is accommodated into the guide bore 102*a* so as to be slidable in a vertical direction.

The die 102*b* is normally urged upward by an urging means 103 such as a compression spring. A lower end portion of the die 102*b* is protrusively provided with a flange 102*d* for preventing the die 102*b* from coming-off from the guide bore 102*a* in such a manner that the flange 102*d* is engaged from lower side with an engaging portion 102*c* provided to an opening portion of the guide bore 102*a*.

A center portion of the die 102*b* is formed with a penetration bore 102*e* penetrating in a vertical direction. An upper portion of the penetration bore 102*e* constitutes a cavity 102*f* for molding a part such as gear. An upper end side of the lower punch 102*g* is inserted from a lower side into the penetration bore 102*e*.

A lower end portion of the lower punch 102*g* is fixed to the lower molding die 102, and a lower pin 102*h* is inserted into a center portion of the lower punch 102*g* so that the lower pin 102*h* is vertically movable.

A lower end side of the lower pin 102*h* is connected to a back-pressure imparting means (see the first embodiment) such as a hydraulic cylinder so that a back-pressure can be imparted to the lower pin 102*h* at the time of upset-forging operation. On the other hand, an upper end portion of the lower pin 102*h* is formed with a tapered portion 102*i* of which diameter is gradually reduced towards the tip portion side thereof.

Next, a method of upset-forging parts such as gear using the above molding die will be explained hereunder.

At first, under a state where the slide is stopped at the upper dead point, a raw material 104 which has been subjected to a surface lubricating treatment (bonderizing treatment) in advance is accommodated into the cavity 102*f* of the lower molding die 102, and a back pressure is imparted in a vertical direction to the upper pin 101*b* and the lower pin 102*h* by the back-pressure imparting means.

Due to this operation, there is obtained a state where the tapered portion 101*c* of the upper pin 101*b* is protruded from the lower surface of the upper punch 101*a* while the tapered-portion 102*i* of the lower pin 102*h* is protruded from the upper surface of the lower punch 102*g*.

Thereafter, the upper molding die 101 together with the slide is lowered, so that the lower surface of the upper punch 101*a* is contacted to the upper surface of the die 102*b* as shown in FIG. 1, so that the cavity 102*f* is closed and the raw material 104 is upset into the cavity 102*f*.

Under this condition, when the slide is further lowered, the die 102*b* is pressed by the upper punch 101*a* and pushed down against the force of the urging means 103, so that the raw material 104 in the cavity 102*f* is pressed in a vertical direction, as shown in FIG. 6, by the tapered portions 101*c* and 102*i* of the upper pin 101*b* and the lower pin 102*h*.

Due to this operation, a part of the raw material 104 flows into a portion of the cavity 102*f* where the tooth shape is molded thereby to mold the tooth-shaped portion of the gear. Simultaneously, a waste hole 104*a* having a tapered-shape is molded to the upper and lower surfaces of the raw material 104 by the tapered portions 101*c* and 102*i* of the upper and lower pins 101*b* and 102*h*.

Thereafter, when the slide is further lowered and reaches to a point close to the lower dead point and the cavity 102*f* is filled with the raw material 104 until a time just before the cavity 102*f* is completely closed, the back-pressures imparted to the upper pin 101*b* and the lower pin 102*h* are removed by discharging the hydraulic oil of the back-pressure imparting means. As a result, there can be obtained a state where the upper pin 101*b* and the lower pin 102*h* can be moved in a direction reverse to the pressing direction of the upper punch 101*a* and the lower punch 102*g*.

Subsequently, under this condition, when the slide is further lowered so as to reach to the lower dead point, the raw material 104 in the cavity 102*f* is further pressed at a portion between the upper punch 101*a* and the lower punch 102*g*, so that the raw material 104 in the cavity 102*f* flows into the waste hole 104*a* while pushing up the upper pin 101*b* and pushing down the lower pin 102*h*, and therefore, the raw material 104 is molded so as to have a thickness of the final shape of the product.

That is, the back-pressures of the upper pin 101*b* and the lower pin 102*h* are removed immediately before the cavity 102*f* is filled up with the raw material 104 to be completely closed, so that excess thickness parts of the raw material 104 can flow into the concave-shaped waste hole 104*a* formed by the upper pin 101*b* and the lower pin 102*h*, and the raw material 104 is injected under pressure so as to have a thickness of the final shape of the product. Therefore, a rapid increasing of the molding load due to the completely closed cavity will not occur, and hence, it becomes possible to perform the molding operation with a small molding load.

Furthermore, when the slide once reached to the lower dead point is thereafter started to rise, the knockout pin (see the first embodiment) of the bed knockout pushes up the lower pin 102*h* from a lower side, so that the raw material having been completely molded in the cavity 102*f* is pushed out from the cavity 102*f*. Then, when the slide reaches to the upper dead point, the back-pressure is imparted again to the upper and lower pins 101*b* and 102*h* by the back-pressure imparting means, so that the tapered portions 101*c* and 102*i* of the upper and lower pins 101*b* and 102*h* are respectively protruded from the lower surface of the upper punch 101*a* and the upper surface of the lower punch 102*g*. As a result, the device is reset so as to wait for the next molding operation.

Thereafter, by repeating the above operations, it becomes possible to upset-forge the gear and to perform the molding operation with a low molding load, so that it becomes possible to lower the surface pressure to be applied to the molding die at the time of the molding operation, thus the life of the molding die being improved.

Figure 8:
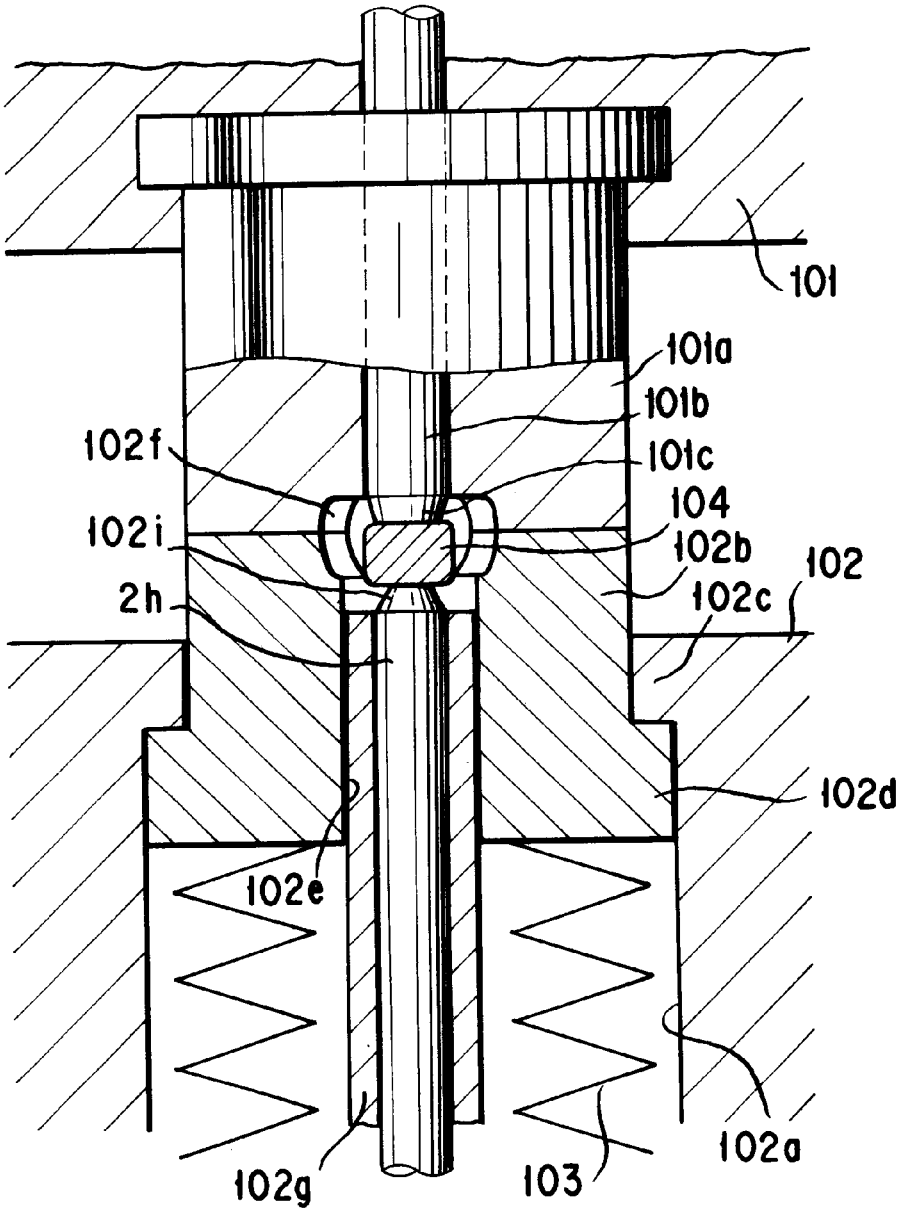
FIG. 8 is a view showing a process of a third embodiment of an upset forging method according to the present invention.
Figure 9:
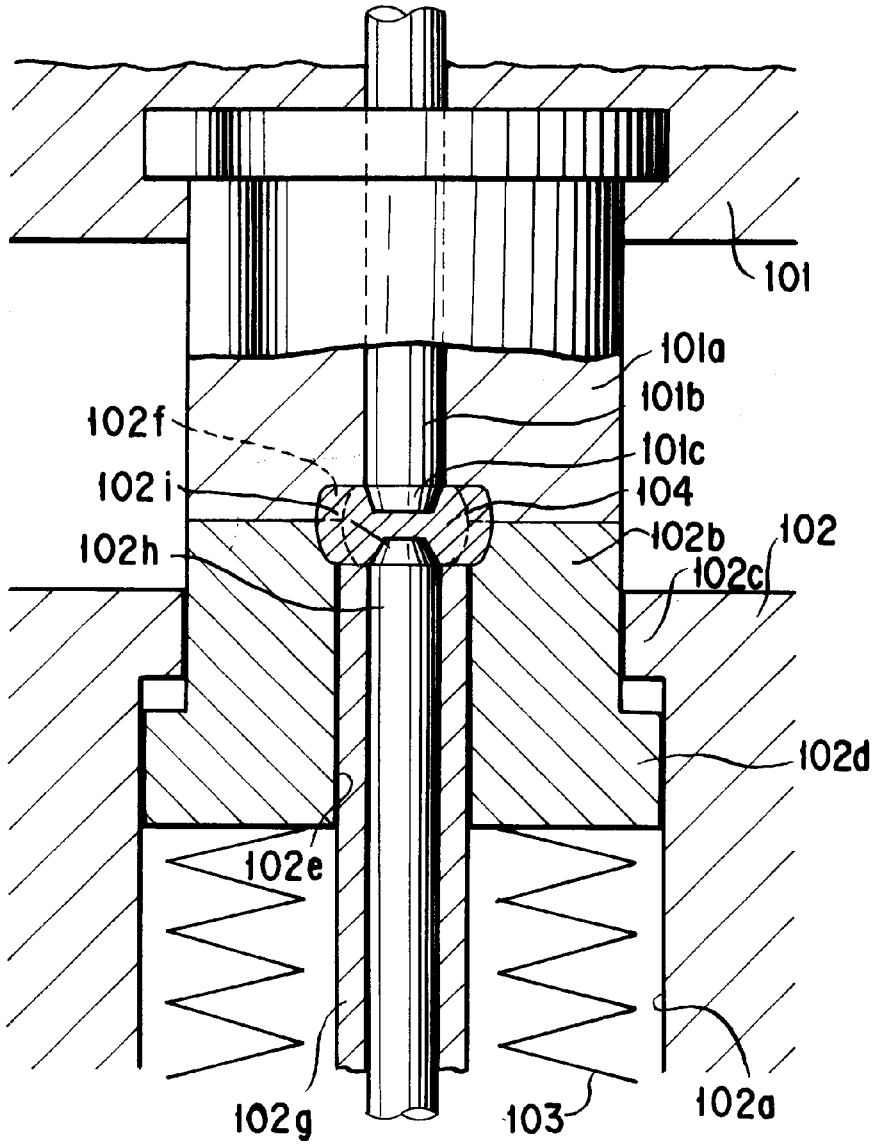
FIG. 9 is a view showing a process of the above third embodiment.
Figure 10:
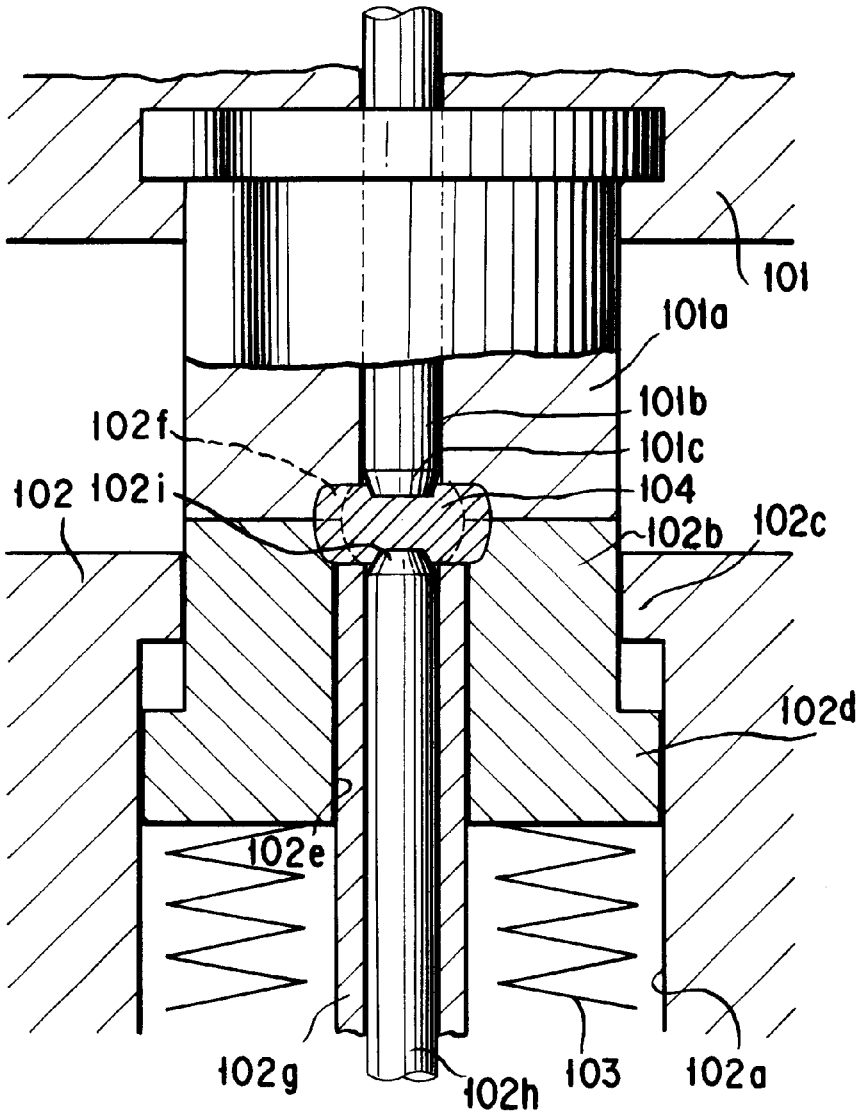
FIG. 10 is a view showing a process of the above third embodiment.

By the way, in the second embodiment, the invention has been explained with reference to the case of upset-forging the gear. However, as indicated in a third embodiment shown in FIGS. 8 to 10, an uniform-motion type ball joint or the like can be also upset-forged in the same method.

Furthermore, machinery parts such as spur gear, polygonal spline, cam lobe, bevel gear, ring gear, scroll gear or the like can be also swage-molded in accordance with the method described above.

Still furthermore, in the second embodiment, the back-pressure is imparted to the upper and lower pins 101*b* and 102*h* in advance, so that the upper punch 101*a* is lowered under a state that the tip portions of these pins 101*b* and 102*h* are protruded from the lower surface of the upper punch 101*a* and the upper surface of the lower punch 102*g* thereby to close the cavity 102*f* of the die 102*b*. However, the following operations may be also adopted. Namely, the lower surface of the upper punch 101*a* is press-contacted to the upper surface of the die 102*b* under a state that the back-pressure is not imparted to the upper and lower pins 101*b*, 102*h* thereby to close the cavity 102*f*. Under this state, the back-pressure is imparted to the upper and lower pins 101*b* and 102*h*, so that the tip portions of these pins 101*b* and 102*h* are protruded from the lower surface of the upper punch 101*a* and the upper surface of the lower punch 102*g*, so that the raw material 104 in the cavity 102*f* is molded under pressure. Subsequent processes will be performed in substantially the same manner as that performed in the second embodiment described above, so that the explanations therefor are omitted herein.

Although the present invention has been described with reference to the exemplified embodiments, it will be apparent to those skilled in the art that various modifications, changes, omissions, additions and other variations can be made in the disclosed embodiments of the present invention without departing from the scope or spirit of the present invention. Accordingly, it should be understood that the present invention is not limited to the described embodiments, and shall include the scope specified by the elements defined in the appended claims and range of equivalency of the claims.

What is claimed is:

1. A forging die device for upset-forging a raw material that is being filled in a cavity of a lower molding die at a portion between an upper punch of an upper molding die provided on a slide and a lower punch of the lower molding die provided on a bolster, wherein said upper and lower punches are provided with an upper pin and a lower pin respectively so that a first end of each pin is protruded and withdrawn from each of end surfaces of said upper and lower punches and said pins are vertically movable in the upper and lower punches respectively, while a second end of said upper and lower pins is applied with a back-pressure by a back-pressure imparting means;

wherein said back-pressure imparting means comprises:

hydraulic cylinders that apply the back-pressure to the upper and lower pins utilizing hydraulic oil, a hydraulic oil supply that supplies the hydraulic oil to the hydraulic cylinders, and a solenoid valve that shuts off and communicates a circuit between the hydraulic cylinders and an oil tank;

wherein said back-pressure imparting means imparts the back-pressure to each of said upper and lower pins by causing the hydraulic oil supply to supply the hydraulic oil to the hydraulic cylinders at a time of a molding operation; and wherein said back-pressure imparting means removes the respective back-pressures by switching the solenoid valve to take a communicating position to discharge the hydraulic oil to the oil tank just before said cavity is completely filled up with the raw material.

2. A forging device according to claim 1, wherein said lower molding die is provided with a knockout pin that knocks out the raw material in said cavity by pushing up said lower pin after completion of the molding operation.

3. A forging die device according to claim 2, wherein a knocking-out speed of said knockout pin is set to no more than 20 mm/sec.

4. An upset-forging method comprising:

imparting a back-pressure to an upper pin provided in an upper punch and to a lower pin provided in a lower punch by supplying hydraulic oil to hydraulic cylinders;

contacting under pressure a lower surface of said upper punch to an upper surface of a molding die under a state where a tip portion of said upper pin is protruded from the lower surface of said upper punch and a tip portion of the lower pin is protruded from an upper surface of the lower punch thereby to close a cavity;

subsequently pressing a raw material into said cavity using the upper and lower pins so that the raw material flows into said cavity, simultaneously pressing the raw material at a portion between the upper punch and the lower punch so that said cavity is filled up with the raw material until a time just before the raw material has completely filled said cavity; and thereafter, further pressing said raw material using the upper and lower punches under a state that said back-pressures on the upper and lower pins are removed by switching a solenoid valve provided between the hydraulic cylinders and an oil tank to a communicating position so that the hydraulic oil is discharged from the hydraulic cylinders to the hydraulic oil tank thereby to mold the raw material in a final shape.

5. An upset-forging method comprising:

tightly closing a cavity by contacting, under pressure, a lower surface of an upper punch to an upper surface of a molding die;

imparting a back-pressure to an upper pin provided in the upper punch and to a lower pin provided in a lower punch by supplying a hydraulic oil to hydraulic cylinders for applying a back-pressure to the upper and lower pins, so that a tip portion of said upper pin is protruded from a lower surface of the upper punch and a tip portion of the lower pin is protruded from an upper surface of the lower punch and a raw material in the cavity is then pressed by means of the tip portions so that said raw material flows into the cavity, and simultaneously pressing the raw material at a portion between the upper punch and the lower punch whereby said cavity is filled up with the raw material until a time just before the raw material has completely filled said cavity; and thereafter, further pressing said raw material using the upper and lower punches under a state that the back-pressures on the upper and lower pins are removed by switching a solenoid valve provided between the hydraulic cylinders and an oil tank to a communicating position so that the hydraulic oil is discharged from the hydraulic cylinders to the hydraulic oil tank thereby to mold the raw material in a final shape.

6. An upset-forging method according to claim 4, wherein the upper and lower pins used to press said raw material are each provided with a tapered-portion at tip portions thereof.

7. An upset-forging method according to claim 5, wherein the upper and lower pins used to press said raw material are each provided with a tapered-portion at tip portions thereof.

* * * * *